US005641288A

United States Patent [19]

Zaenglein, Jr.

[11] Patent Number: 5,641,288

[45] Date of Patent: Jun. 24, 1997

[54] SHOOTING SIMULATING PROCESS AND TRAINING DEVICE USING A VIRTUAL REALITY DISPLAY SCREEN

[76] Inventor: William G. Zaenglein, Jr., 1235 Skyline Dr., Laguna Beach, Calif. 92651

[21] Appl. No.: 584,349

[22] Filed: Jan. 11, 1996

[51] Int. Cl.[6] ..... F41G 3/26

[52] U.S. Cl. ..... 434/21; 434/17; 434/19; 434/307 R; 463/51; 395/806

[58] Field of Search ..... 434/16–24, 27, 434/307 R, 308, 365; 395/127, 135, 152, 154, 155, 156, 161; 364/578, 410, 411; 345/7–9, 156, 157; 348/14, 61; 273/348, 359, 371, DIG. 28; 463/49–53; 250/330; 73/167

[56] References Cited

U.S. PATENT DOCUMENTS

| | | | |
|---|---|---|---|
| 2,995,834 | 8/1961 | Rowe | 434/21 |
| 3,882,496 | 5/1975 | Lewis et al. | 434/21 X |
| 4,218,834 | 8/1980 | Robertsson | 434/21 |
| 4,336,018 | 6/1982 | Marshall et al. | 434/22 |
| 4,439,156 | 3/1984 | Marshall et al. | 434/22 X |
| 4,629,427 | 12/1986 | Gallagher | 434/21 X |
| 4,640,514 | 2/1987 | Myllylä et al. | 434/22 X |
| 4,898,391 | 2/1990 | Kelly et al. | 434/22 X |
| 4,963,096 | 10/1990 | Khattak et al. | 434/21 |
| 4,988,111 | 1/1991 | Gerlizt et al. | 434/22 X |
| 5,194,006 | 3/1993 | Zaenglein, Jr. . | |
| 5,281,142 | 1/1994 | Zaenglein, Jr. . | |
| 5,354,057 | 10/1994 | Pruitt et al. . | |
| 5,359,576 | 10/1994 | Bunner et al. . | |
| 5,366,229 | 11/1994 | Suzuki . | |

*Primary Examiner*—Joe Cheng
*Attorney, Agent, or Firm*—Rudnick & Wolfe

[57] ABSTRACT

A user friendly shooting simulating process and training system are provided to more accurately and reliably detect the impact time and location in which a projectile shot from a shotgun, rifle, pistol or other weapon, hits a moving target. Desirably, the shooting simulating process and training system can also readily display the amount by which the projectile misses the target. The target impact time is based upon the speed and directions of the target and weapon, as well as the internal and external delay time of the projectile. In the preferred form, the training system includes a microprocessor and special projectile sensing equipment, and the targets and projectiles are simulated and viewed on a virtual reality head mounted display.

56 Claims, 4 Drawing Sheets

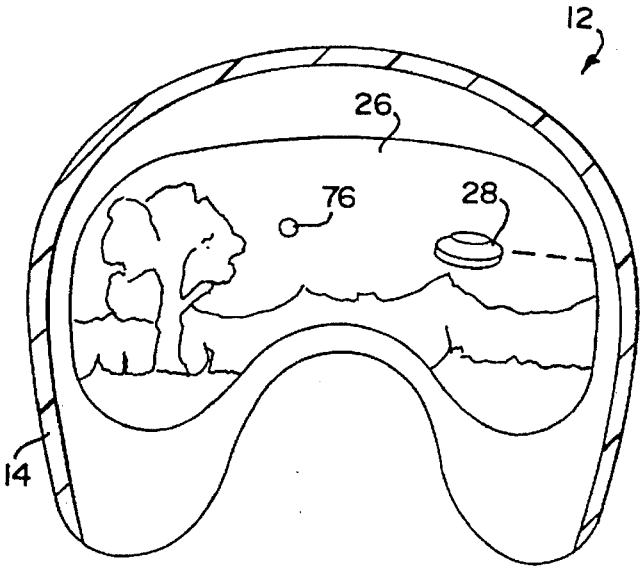
FIG. 4
FIG. 5
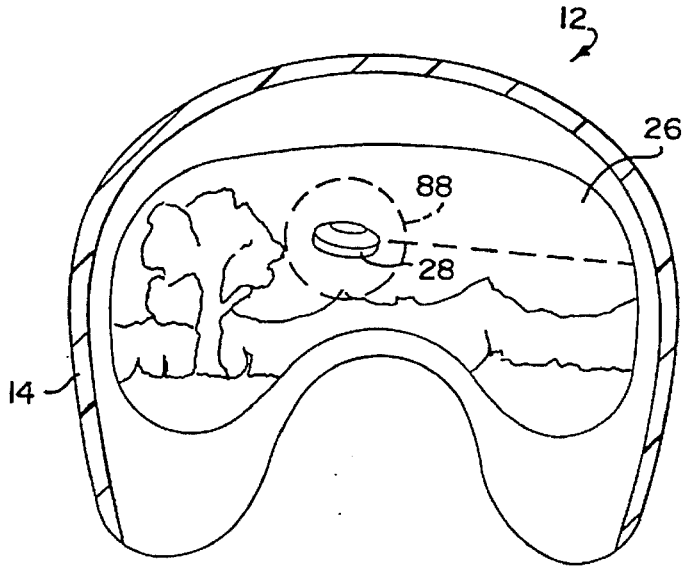

SHOOTING SIMULATING PROCESS AND TRAINING DEVICE USING A VIRTUAL REALITY DISPLAY SCREEN

FIELD OF THE INVENTION

This invention pertains to ballistic simulators and, more particularly, to a training device and process for improving the skill and accuracy of shooting weapons, such as shotguns and dries.

BACKGROUND OF THE INVENTION

It has long been desired to provide personnel training to improve their skills in aiming and firing shotguns, rifles, handguns, and other weapons. In the past, many different types of target practice and aiming devices have been suggested that use light to simulate the firing of a gun. Such devices help train and instruct shooters by enabling them to practice aiming at a target either indoors or on an open range without actually making use of real projectiles (e.g. shot charges or bullets). The position of a projectile can be simulated by a computer and compared with the target position in order to determine whether the aim is correct.

In some systems, shooters use a gun which emits a light beam to project a luminous mark on a screen. A successful shot results when the light beam emitted from the gun coincides or aligns with the target on the screen. A successful shot by the marksperson is typically indicated by the cancellation of the target or the display of the simulated object which has been hit. Electronically controlled visual and audio indicators for indicating the hit have also been used.

In one prior art system, the flight of the target object is indicated by a constant change in the area and configuration of the target through changing the block area of the mark aperture by movable shutter members. When the mark is hit, the movement of the shutters is ceased and a fixed configuration is projected and the flapping of the bird's wings stops. There is no way of indicating, however, that the target has been hit other than by stopping the movement of the projected image.

When using a light beam gun to shoot a concentrated light beam, such as a laser beam, a target apparatus can be used to indicate the position of impact of the simulated projectile. One typical target apparatus comprises a light-receiving element such as a photo-diode or photoconductive cell. When used alone, however, such a light-receiving element can only detect whether or not a light beam discharged by a light gun has landed within a specified range on a target defined by the area of the light-receiving surface but does not indicate the exact spot within the specified range where the light beam impacts.

To eliminate these difficulties, it has been suggested to use an electronic target apparatus with numerous light-receiving elements arranged in a plane so as to indicate which of the elements has received a light beam released by a light beam gun. A light beam gun in practical use projects a small shot mark approximating a circle having a diameter of several millimeters. To indicate such a small shot mark on a target, it has been necessary to emit lights to correspond to the impact of simulated projectiles. Voluminous light-receiving elements have been used resulting in complex expensive electronic training equipment.

Another example of prior art shooting devices involves a clay shooting system utilizes a light-emitting gun and a flying clay pigeon target provided with a light responsive element. Because the light responsive dement is provided in the clay, a hit occurs when the light responsive element in the clay bird detects the light beam from the gun. To its detriment, and to the detriment of the user of such a device, lead sighting, which is required in actual clay shooting, cannot be simulated by this system. Moreover, since the clay pigeon actually flies, the clay pigeon has to be retrieved for further use.

Training devices have been provided for the operation of rocket launchers, guided missile launchers, shoulder weapons or weapons of a similar type by providing the operator with conditions which are very close to those likely to be encountered under real firing conditions. Interest has also focused on training in the firing of guns from tanks, combat vehicles or other ruing units of similar types.

Traditional training methods in marksmanship and firing tactics for hunters and other sportsmen, police, military personnel, and others, leave much to be desired from the aspects of realism, cost and practicality. Many firing ranges have limited capacity. Moreover, most existing firing ranges do not provide protection for the shooter against the natural elements such as rain or snow. Because of the noise levels normally associated with firing ranges, they are typically located in remote areas requiring people to have to drive to such remote locations. The ammunition, targets and use costs for the range, make such adventures expensive.

In most ranges, the targets are stationary. Furthermore, when live ammunition is used, expense, risks, administrative problems, safety concerns, and government rules and regulations are more burdensome. For initial training in marksmanship and tactics, it is preferred to have an indoor range where shooters can fire simulated projectiles against simulated moving targets.

In other systems, moving targets are projected on an indoor screen from a motion picture film and low power laser beams are aligned with the weapon barrel to simulate the firing of live ammunition. Shooters aim and fire their weapons at targets shown on the screen.

Over the years a variety of weapon simulators, training devices and other equipment have been suggested, as well as various techniques and methods for their use. Typifying these prior art weapon simulators, training devices, equipment, techniques, and methods are those describe din U.S. Pat. Nos. 2,042,174; 2,442,240; 3,675,925; 3,838,856; 3,388,022; 3,904,204; 4,111,423; 4,137,651; 4,163,557; 4,229,009; 4,534,735; 4,657,511; and 4,799,687. These prior art weapon simulators, training devices, equipment, techniques, and methods have met with varying degrees of success, but are often unduly expensive, difficult to use, complex and inaccurate because they fail to consider the internal delay of the projectile passing through the weapon after the trigger has been pulled and the external delay during which the projectile travels to the path of a moving target.

It is, therefore, desirable to provide an improved shooting simulator and process which overcomes most, if not all, of the preceding problems.

SUMMARY OF THE INVENTION

In view of the above, and in accordance with the present invention, there is provided a ballistic shooting simulator that provides a user friendly training device for improving the skill and accuracy of shooting a weapon such as a shotgun, rifle or handgun. A ballistic training and simulator process are disclosed. Advantageously, the novel training device and method are easy to use, simple to operate, comfortable and helpful. Desirably, the user friendly training device and method are also effective, convenient, dependable and accurate.

According to one aspect of the present invention there is provided an improved ballistic simulating and training process or method. The ballistic simulating and training process of the present invention involves: inputting to a central processing unit a predetermined path and speed of a simulated target; displaying the movement of the target upon a screen contained in a virtual reality head mounted display system equipped with an internal screen such that different locations on the screen schematically represent different distances the target moves relative to a predetermined station. As will be appreciated, by inputting the predetermined speed and predetermined path of travel of the target, the central processing unit "knows" the position of the simulated target at all times during its path of travel or movement across the screen. The ballistic simulator and training process further includes the step of: simulating aiming and firing of a freely movable weapon such as a rifle or shotgun at the simulated target moving across the screen. The freely movable weapon defines the predetermined station relative to which the target appears to move and preferably includes a trigger with a sear and a barrel providing a muzzle. When the weapon is "fired", a simulated projectile moves toward the target. The step of simulating firing of the weapon includes projecting light rearwardly toward the head mounted display at the time a projectile would exit the muzzle of the weapon. As long as the weapon is properly situated and aimed, the direction and aim of the weapon is monitored and displayed on the screen at all times during aiming and "firing" the weapon.

The process of the present invention furthermore involves the step of: sensing the orientation of the head display system relative to a fixed location and, thus, relative to the target as well as sensing the aim of the weapon at the time the projectile is discharged from the muzzle of the weapon. The present invention includes the further steps of: ascertaining the relationship of the direction of the weapon's barrel to the moving target by signaling to the central processing unit at all times while the weapon is aimed, including at the time the projectile would exit the muzzle of the weapon; determining the position of the target; and calculating the positions of the moving target and the projectile to determine whether the target has been "hit" or "missed." To enhance the ability of the user to perfect their shooting skills, the process of the present invention further includes the step of: displaying the positions of the projectile and the target when the trajectory of the projectile intersects with the plane of the moving target.

The process of the present invention is enhanced by including steps to more accurately reflect the natural environment wherein weapons are used. That is, the process of the present invention further includes the step of: simulating an internal delay time it takes for the projectile to pass through the barrel of the weapon from the time the sear of the trigger slips to the time it takes the projectile to exit the muzzle of the weapon. The process of the present invention is still further enhanced by preferably including in the process the further step of: automatically calculating an external delay time required for the projectile to travel from the muzzle of the weapon to the plane of the target, and wherein the position of the target is determined, in part, based upon the external delay time.

For more realistic training, the target can be displayed as moving towards, away, or at an angle of direction or inclination relative to the shooter trainee, marksman, hunter, or other sportsman or person firing the weapon. The weapon can also be moved relative to the target. The weapon can be further aimed to the left or fight of the moving target or aimed to shoot the projectile ahead of the moving target in either a static position or while moving the weapon so that its point of aim catches up to and passes the target.

In a preferred form of the invention, the display on the screen of the head mounted virtual reality apparatus can be activated by voice. In a most preferred form of the invention, the process includes the further step of: providing an environment on the screen of the head mounted display such that it appears the shooter is immersed in the environment illustrated. The environment in which the shooter appears to be immersed is provided by superimposing the target over an environment or by including the target as part of the scene. In a preferred from of the invention, the environment can include a landscape pattern, or other surrounding background projected upon the screen of the head mounted display. Alternatively, the environment can include a shooting range wherein the environment and target are simultaneously displayed on the screen of the head mounted display system. Such scene and target may be projected by a television, video cassette recorder (VCR), a conventional CDI system, film projector or other suitable apparatus Moreover, the target can be a clay target, bird (pigeon, duck, etc.), animal (e.g. running boar, deer, lion, tiger, bear), disc, or can simulate an enemy, criminal, or other military or police target.

The position of the moving target can be continually or intermittently determined. The trajectory of the projectile is sensed from sensor units mounted on the head mounted display. The head mounted display may include another sensor unit or a gyroscope for locating the person relative to the scene in which they are immersed. If the projectile misses the simulated target, the missed distance is displayed by illustrating the simulated positions of the projectile when it crosses the plane or path of the target so that the shooter can correct their aim.

While the preceding process can be accomplished with various equipment and apparatus, a preferred user friendly ballistic simulating and training system includes a virtual reality head mounted display equipped with a screen that fits over and in front of a person's eyes for viewing a simulated moving target and a simulated projectile shot towards the target. A sensor unit operably associated with the head mounted display system produces an output signal representing the orientation of the head mounted display and, thus, the scene represented on the display screen of the head mounted display relative to a fixed location. A light projector is preferably mounted about the barrel of a weapon (e.g. shotgun or rifle). The weapon is freely movable relative to the screen and includes a trigger with a sear and wherein the barrel defines a muzzle. Another sensor unit or apparatus is also operably associated with the head mounted display and is responsive to light projected from the light projector mounted on the barrel of the weapon. The second sensor unit produces a signal representing orientation of the weapon relative to the head mounted display system and, therefore, to the fixed location and furthermore the trajectory of the projectile.

The head mounted display is conventionally coupled to a unit that includes a myriad of operably interconnected components. According to one embodiment of the invention, the unit is coupled to a screen projector that provides a visual display of an environmental image for the screen of the head mounted display. The unit also includes a target projector that provides a visual display of a path of travel of a moving target on the screen of the head mounted display preferably in overlying relation to the environmental scene depicted on the screen by the screen projector. Alternatively, the unit can include an apparatus such as a VCR or video disc player that displays both the scene and the target moving through the scene on the screen of the head mounted display. Such an apparatus may further embody technology that provides informational data regarding the target's speed(s) and external delay times to the target's path of travel to a computer or microprocessor. Such informational data can be supplied by a tape or disc operably associated with each particular target selected. As will be appreciated, each tape or disc is coded with informational data related to the position of the target and/or its path of travel so that this position may be relayed to the computer or microprocessor at the time the shot is taken.

The computer or microprocessor is operably connected to the screen projector, the target projector (when they are separate entities or to the apparatus that conjointly displays the scene and target), and also to the sensor units mounted on the head mounted display system. As will be appreciated, various computer programs can be used in conjunction with the microprocessor such that the speed of the projectile as well as the position and speed of the target are known at all times during their schematic illustration on the screen of the head mounted display. Furthermore, the microprocessor controls the environmental image and/or target displayed on the screen of the head mounted display such that the person wearing the display will feel immersed in the environmental image displayed on the screen as a function of the orientation of the head mounted display relative to the fixed location as monitored by the sensor on the display.

During operation of the training apparatus of the present invention, the microprocessor automatically calculates or is inputted with the positions of the moving target and is signalled with the position of the projectile. When the trajectory of the projectile intersects or passes through the path of travel of the target, the microprocessor calculates whether the target was "hit" or "missed" by the projectile. To effect such ends, the microprocessor automatically determines the position of the target at the time the projectile leaves the weapon.

According to the present invention, and to impart as much reality into the present invention as possible, the microprocessor furthermore calculates the external delay time required for the projectile, after leaving the muzzle of the weapon, to intersect a simulated plane of the target based on the output signal from the sensors that monitor the position of the weapon and the scene. The microprocessor furthermore calculates the distance the target will travel during the external delay time of the projectile to automatically determine the relative positions of the target and the projectile at the expiration of the external delay time. Upon "firing" of the weapon, and preferably following the expiration of an internal delay, the sensors, on the head mounted display system are disabled and the microprocessor serves to project the relative positions of the target and projectile preferably on the internal screen of the head mounted display. That is, the unit serves to display the positions of the target and the projectile calculated by the microprocessor at the time the trajectory of the projectile intersects with the path of travel of the target thereby yielding a visual indication of whether the target was hit or missed by the shooter. In a most preferred form, the display shows the extent to which the target was hit or missed by the shooter to allow for subsequent correction.

As mentioned above, a light projector is mounted about the barrel of the weapon for directing a light rearwardly toward the sensor on the head mounted display system indicative of the position of the weapon and when a simulated projectile exits the muzzle of the weapon. In an effort to continue to improve the training capabilities of this training system of the present invention, the light projector preferably includes a delay apparatus in association therewith. The delay apparatus is responsive to the person pulling the trigger and serves to delay when the signal is provided to the sensor on the head mounted display indicative of when the simulated projectile exits the muzzle of the weapon. The delay preferably inherent with the light projector is preferably called "an internal delay time" and can be characterized as the delay occurring between the time the trigger sear releases a hammer which in turn hits a firing pin, striking a primer which explodes the powder in a cartridge, with the gases from the explosion propelling a bullet, shot charge, or projectile through the barrel until it leaves the muzzle of the firearm and, therefore, is no longer under the control of the firearm and, accordingly, of the shooter. This is an actual, detectable and measurable delay which occurs in discharging firearms and the distance which a swinging gun moves during this time is accorded the term "overthrow" in some British books written on the subject of shotgun shooting°

Internal delay is important because in the event, for instance, a shooter is swinging a firearm to overtake a moving target from the rear, so that the point at which the gun barrel is directed on the plane of that target moves at a greater steady speed than the target itself, or because this point is actually being accelerated past the target by the shooter, if the shooter presses the trigger and therefore slips the hammer sear at exactly the point where the gun is pointing at the target, the bullet or shot will leave the barrel of the gun at a point which is perceptibly ahead of the target on that target's plane. The converse is true in the event that the shooter starts ahead of the target and swings the gun more slowly than the motion of the target, so that the target gains on the barrel's position during the internal delay. If the trigger is pulled when the gun points directly at the target, the projectile will land behind the target on its plane, and this is true even if the projectile travelled from the muzzle to the target's plane as instantaneously as light would, i.e. even without taking into account the further disparity caused by the external delay time of the projectile's travel once it has left the firearm's muzzle.

As mentioned above, the microprocessor furthermore calculates the distance the target will travel during the external delay time of the projectile to automatically determine the relative positions of the target and the projectile at the expiration of the external delay time. External delay time can be characterized as the delay between the time the projectile exits the muzzle of a firearm and the time at which it reaches that point on the plane of the target's path at which the muzzle was directed at the time of such exit. At any given speed of a projectile, the external delay will be proportional and determine how far the target travels between the time the projectile exits the firearm's muzzle and the time it reaches the plane of the target.

As mentioned above, the positions of the target at all times as it moves along its path, are "known" by the microprocessor because of the information provided thereto through any of several different methods. Upon receiving a signal from the light projector, representing the projectile leaving the firearm's muzzle, the microprocessor determines the target's position at such time. After applying the external delay attributable to the sensed position of the light spot representing the point at which the projectile will cross the target's plane, the positions of the projectile and target are signaled to the microprocessor, and processed therein. Based upon this information and signals, the microprocessor can determine and indicate whether the projectile will strike the target and, if not, can indicate their relative positions, and therefore the span and distance missed between the target and projectile when it crossed the path of the target. Visual display of a hit or the amount of a miss can be projected on the screen of the head mounted display for viewing by the shooter.

The head mounted display preferably includes a helmet having a concave screen on the interior thereof. Based upon various programs simulating different target distances and directions combined with various projectile velocities that are inputted to the microprocessor, each point on the screen where the shooter could project a shot could represent a different measurable distance from the station whereat the shooter is located and, therefore, a different programmed-in, sensed external delay to the target's plane and can be determinative of the distance which the target will travel between the target position at the time the simulated projectile exits the muzzle of the weapon and the time the simulated projectile would cross or intersect the plane of the target. It is also within the spirit and scope of the present invention, however, to configure the head mounted display from glasses with two relatively small screens that fit over the eyes of the person wearing the head mounted display to immerse the wearer in the images they see.

In a preferred form of the invention, the sensor unit on the rear side of the head mounted display includes an apparatus from the class of: a light sensing apparatus or a gyroscope. It is well within the spirit and scope of the present invention, however, to use other mechanisms or devices for providing a signal indicative of a fixed location. In the illustrated embodiment, the sensor unit on the front side of the head mounted display includes a light sensing apparatus from the class comprised of: infrared sensing monitors, normal light sensing monitors, optical fibers, and liquid crystals. The sensor unit on the front side of the head mounted display is configured such that unless the weapon is properly held during the training process, the screen of the head mounted display will indicate that correction is required. Accordingly, and in addition to the other training benefits afforded by the present invention to the user, the present invention furthermore teaches proper orientation of the weapon for the shooter, thus, facilitating improved handling of the weapon.

Desirably the shooting simulating processes and training devices of this invention displays the relative positions of a miss when the projectile crosses the upright plane (or, if it is rising or falling directly away from the shooter, the horizontal plane) of the target and have the realism of a projected, actual target and background. Furthermore, the inventive processes and systems are extremely accurate in showing the leads required to hit a target for all different speeds, angles, and distances based upon both the internal delay time and external delay time. ning devices can freeze the scene when a projectile crosses and intersects the target's path to show a hit or miss, and if a miss by how much. Preferably, the shooting stimulating processes and training devices can also program for angling outgoing or incoming targets, and wind speeds and directions as well as for various projectile velocities and trajectories.

These and other objects, aims, and advantages of the present invention will become readily apparent from the following detailed description, appended claims, and the following drawings.

BRIEF DESCRIPTION OF THE DRAWINGS

FIG. 4 is an internal view of one form of a head mounted display including an internal screen having an environmental scene projected thereon for use with the shooting simulating process and training device as seen looking forward at the scene;

FIG. 5 is an internal view of the head mounted display similar to that schematically shown in FIG. 4 looking forwards at the scene projected onto the screen of such head mounted display after the shooter has shot at the target and the projectile has reached the plane of the target;

DETAILED DESCRIPTION OF THE PRESENT INVENTION

Figure 1:
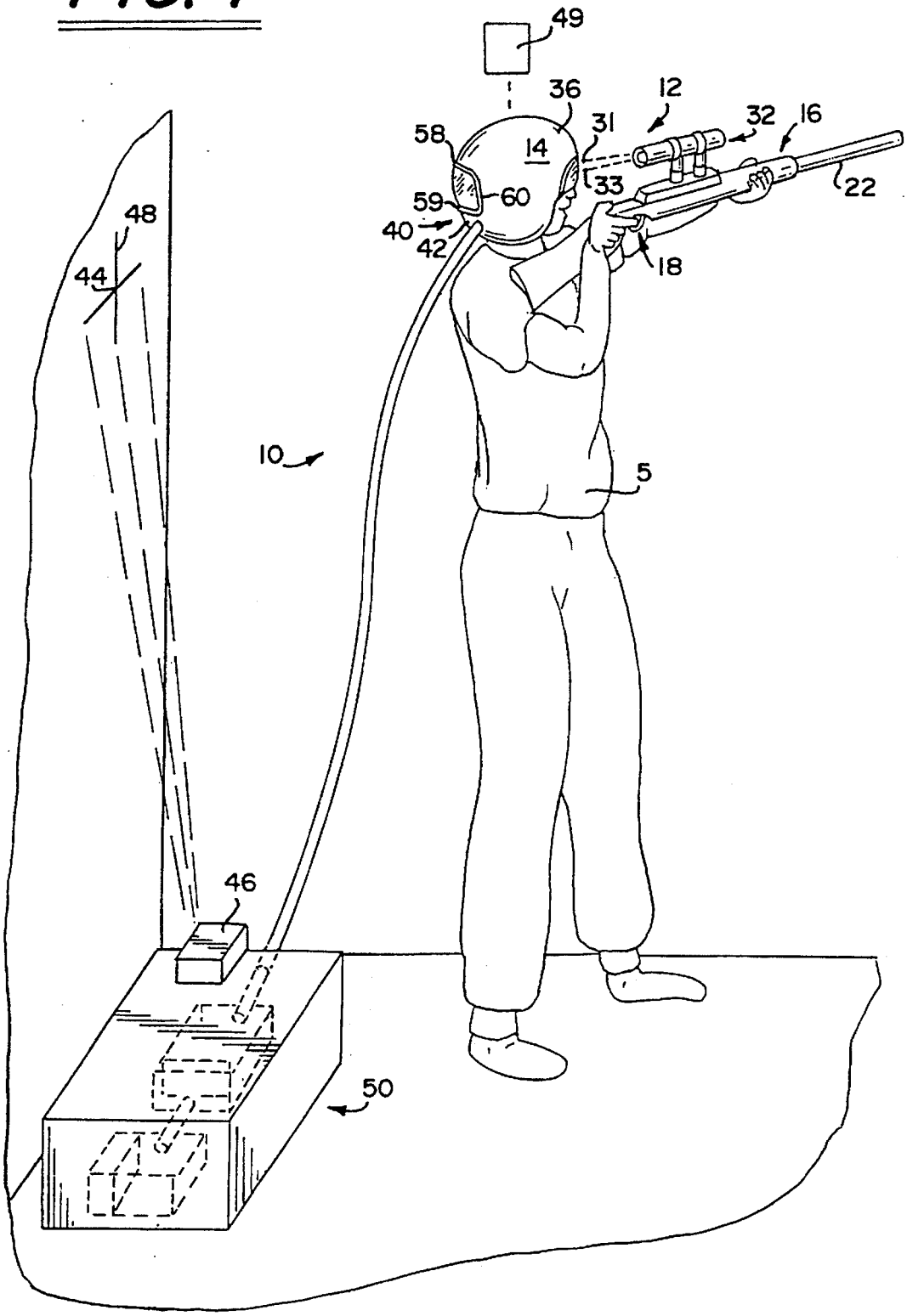
FIG. 1 is a perspective view of a shooter using a shooting simulating process and training device in accordance with principles of the present invention.

While this invention is susceptible of embodiment in various forms, there is shown in the drawings and will hereinafter be described in detail a specific embodiment with the understanding that the present invention is to be considered as an exemplification of the principles of the invention and is not intended to limit the invention to the specific embodiment illustrated.

In view of the above, and in accordance with the present invention, a schematic illustration of a shooting simulating process and training apparatus is represented in its entirety in FIG. 1 by reference numeral 10. The shooting simulating process and training apparatus 10 can be used to simulate skeet, trap, bird or game shooting, or shooting military or police targets at any simulated distance. The apparatus 10 of the present invention includes a virtual reality head mounted display 12 which, in one form of the invention, includes a helmet 14 that fits about the head of a shooter S to immerse the shooter in an environment as will be discussed in detail below.

Figure 2:
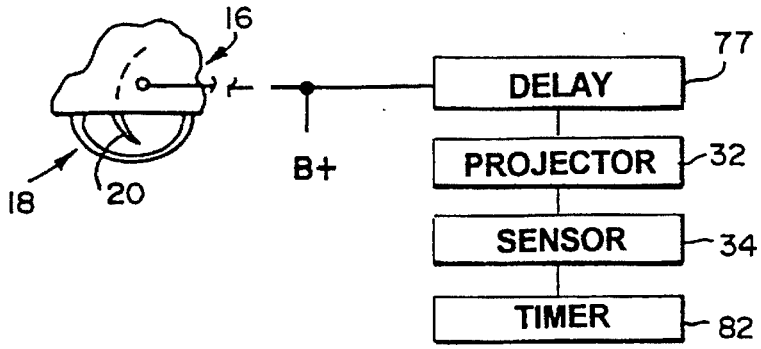
FIG. 2 is a fragmentary showing of a portion of the apparatus of the present invention and sequential steps that follow manipulation of a trigger mechanism of a weapon forming part of the present invention.

The apparatus 10 of the present invention further relies on the use of an unloaded and yet conventional firearm or weapon 16 that may be selected from the class or group of: a shotgun or rifle. As is conventional, such weapon 16, used in combination with the present invention, typically includes a manually operated sear firing mechanism 18 (FIG. 2) including a trigger 20. Returning to FIG. 1, the weapon selected for use in combination with the present invention typically further includes an elongated barrel 22 defining a muzzle of the weapon In regards to the apparatus 10 of the present invention, the purpose of the weapon 16 (FIG. 1) is to "fire" a simulated projectile from the weapon 16 in response to manipulation of the trigger 20 (FIG. 2). As will be discussed in detail below, in a preferred form of the present invention, the velocity of the projectile as it exits the muzzle of the weapon 16 and the projectile's rate of slowing can be selected by the shooter S to simulate that which is inherent with an actual projectile fired from the muzzle of an actual weapon of the type selected for use in combination with the present invention.

Turning now to FIGS. 4 and 5 the head mounted virtual reality display 12, which in the illustrated embodiment includes a helmet 14, further includes a conventional internal concave configured screen 26 that fits over and in front of the eyes of the shooter S. As will be discussed in further detail below, during use of the apparatus 10 of the present invention, either: a moving target 28 will be displayed on the screen 26 of the head mounted display system 12; or, a visual display of an environmental image is provided on the screen 26 of the head mounted display 12 with a simulated target 28 being superimposed on the scene or environmental image so as to immerse the shooter S in the scene depicted upon the screen 26; or, a combined simulated target and visual display will be conjointly displayed on the screen 26 of the head mounted display system 12.

As will be discussed below, in a preferred form of the invention, the apparatus 10 of the present invention allows the shooter to select both the environment as well as the particular simulated target 28 to be displayed on the screen 26 of the display 12. In a most preferred form of the invention, the simulated path of the target 28 can appear to angle toward or away from the shooter S, or the simulated path of the target 28 can appear to come directly toward or over the shooter S, or, the simulated target path can appear to cross in either a left to fight or right to left direction across the screen 26 of the display 12o As will also be discussed below, in a preferred form of the invention, the shooter S can select the simulated velocities of the target 28 as it appears to move on the screen 26 of the display 12.

Returning to FIG. 1, a light projector 32 is mounted and carried on the barrel 22 of the weapon 16. The light projector or barrel position indicator 32 directs a suitable light source such as two vertically spaced rays of light 31, 33 rearwardly toward the virtual reality head mounted display 12. In the illustrated form of the invention, the rays of light 31, 33 produced by the projector 32 can be a normal light, infrared light, or other light forms that are readily detectable by sensors.

Notably, two distinct levels of light are directed rearwardly toward the head mounted display by the light projector 32. During normal swinging movements of the weapon 16, the light projector 32 directs a first or lower level of light rearwardly toward the head mounted display 12. When the shooter S pulls the trigger 20 of the firing mechanism (FIG. 2), the light projector 32 rearwardly directs a second or higher level of light toward the head mounted display 12 for denoting the direction and position of the barrel 22 at the instant a simulated projectile exits the muzzle of the weapon 16.

Figure 3:
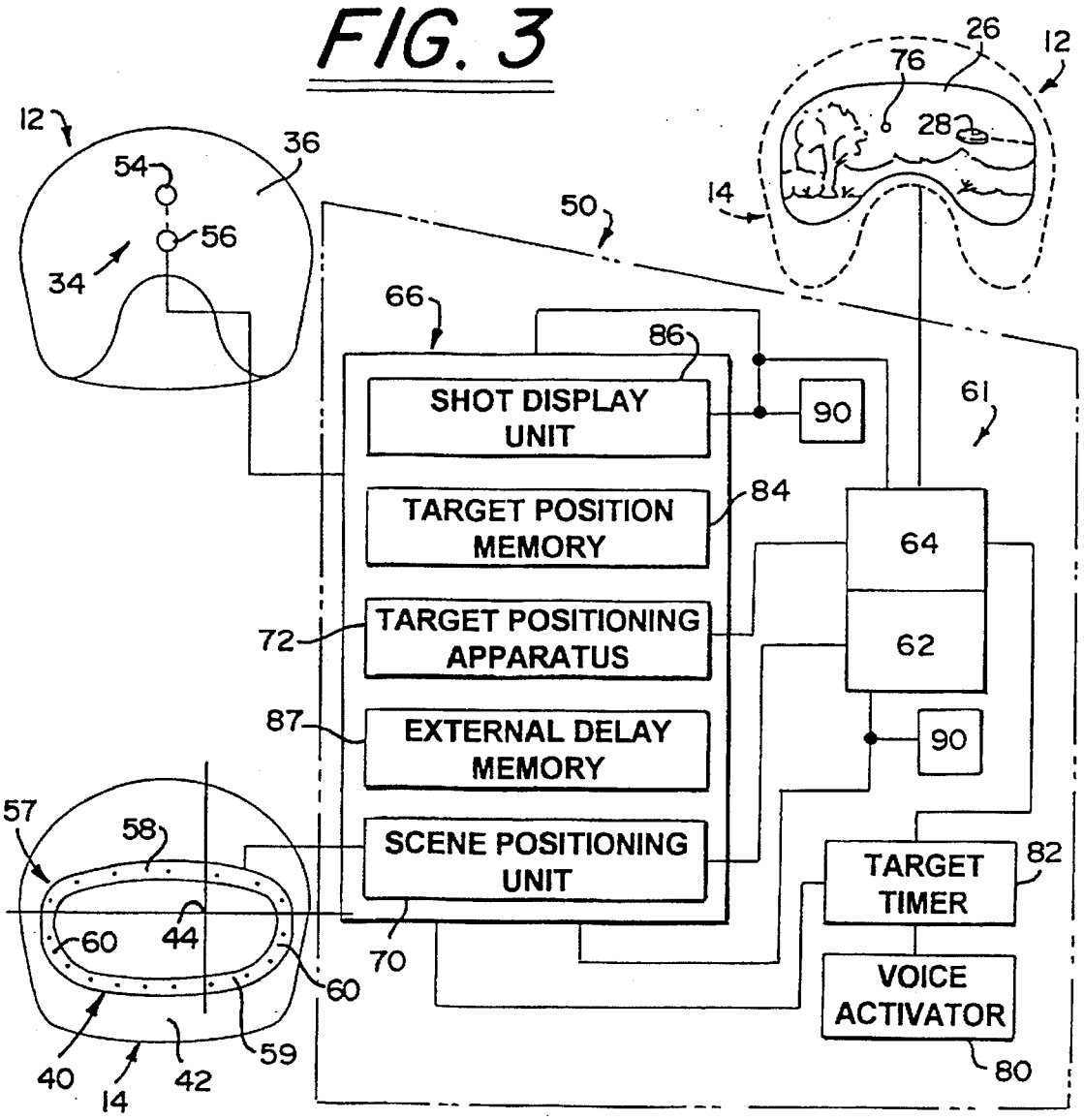
FIG. 3 is a schematic block diagram of various components of the present invention.

As furthermore illustrated in FIG. 3, the head mounted display 12 is provided with a barrel position sensor unit 34 for sensing the relation of the direction of the barrel 22 of the weapon 16 (FIG. 1) relative to the head mounted display 12. In the illustrated form of the invention, the barrel position sensor unit 34 is mounted on a front side 36 of the helmet 14 and is capable of producing an output signal.

Another side of the helmet 14 is provided with a virtual reality display sensor unit 40 which is likewise capable of producing an output signal. In the illustrated form of the invention, the virtual reality display sensor unit 40 is on a rear side 42 of the helmet 14. The purpose and function of the virtual reality display sensor unit 40 is to monitor and sense the relationship of the helmet 14 relative to a fixed reference location, schematically represented in FIG. 1, by reference numeral 44. The fixed reference location 44 is preferably provided by projecting a pattern of light on a wall or the like as by a light projector 46 (FIG. 1) forming part of a unit 50 (FIG. 3) described in detail below. The light projector 46 preferably projects a cross-hair pattern 48 as shown in FIG. 1.

As schematically represented in FIG. 3, the barrel position sensor unit 34 on the front side 36 of the helmet 14 includes two vertically spaced and generally vertically aligned individual sensors 54 and 56. In a most preferred form of the present invention, the sensors 54 and 56 are designed to produce a common output signal in only that situation wherein both sensors 54 and 56 detect rays of light 31, 33 from the barrel position indicator 32. If the two sensors 54 and 56 do not conjointly detect the rays of light from the barrel position indicator 32, no output signal is produced or sent to the microprocessor 32. Using this design, the shooter S is taught to hold the weapon in a correct manner during the shooting exercise or training process.

The virtual reality display sensor unit 40, as shown in FIGS. 1 and 3, preferably includes a sensor assembly 57. The sensor assembly 57 preferably comprises arrays of individual sensors arranged in a rectangular pattern. That is, the sensor assembly 57 includes an upper row 58 of individual light detecting sensors that extend generally horizontally across the rear side 42 of the helmet 14. The sensor assembly 57 also includes a lower row 59 of individual light detecting sensors that extend horizontally across the rear side 42 of the helmet 14 beneath the upper row 58 of sensors. Moreover, the sensor assembly 57 preferably includes horizontally spaced and vertically disposed arrays or rows of light detecting sensors 60 that preferably extend between the upper and lower rows of light detecting sensors 58 and 59, respectively. As will be appreciated by those skilled in the art, each sensor in the rows of sensors 58, 59 and 60 is capable of producing an output signal in response to the individual detection of light thereby. As will be appreciated, the sensors in the rows of sensors 58, 59 and 60 individually sense the cross-hair pattern 48 indicative of the orientation of the head mounted display system 12 relative to the fixed reference location 44 and signal the unit 50 accordingly.

The sensors 54 and 56 on the from side 36 of the helmet 14 and the individual sensors in each row of sensors 58, 59 and 60 are preferably from the class comprised of: infrared sensing monitors, normal light sensing monitors, optical fibers, and liquid crystals. In a most preferred form of the invention, the sensors used on the helmet 14 are somewhat "channelized" in their perception of light. That is, the individual sensors on the helmet 14 are unilaterally responsive to light projected to the front and rear faces or sides 36 and 42 of the helmet 14 such that only one or a relatively few of the sensors which are most in line with the fight monitored or detected thereby, whether such light is derived from the barrel position projector 32 or by the fixed location light projector 46, produce an output signal.

Regarding the sensor assembly 57 on the rear side 42 of the helmet 14, in the event that more than one particular sensor in a row of sensors is activated by light, the orientation of the head mounted display 12 relative to the fixed location 44 may be ascertained utilizing light weighing techniques known to be used to determine the amount of light exposure to which camera film is subjected in auto-exposure cameras. The accuracy of such light detection sensing techniques is demonstrated by the sensing system used to find the directional change of the M1A1 Abrams tank's cannon due to warpage of the barrel caused by the heat generated in firing repetitive or successive rounds.

As will be appreciated by those skilled in the art, other devices for monitoring the position or tracking movements of the head mounted display system 12 relative to a fixed location are likewise intended to be within the spirit and scope of the present invention. For example, rather than using the light projector 46 for projecting a fixed location 44, it is well within the spirit and scope of the present invention that a suitable light source be used to direct a beam of light directly toward the sensor assembly 57 on the rear side 42 of the helmet 14. Another alternative embodiment would involve the use of radio or magnetic signals for monitoring the position of the helmet 14 relative a fixed reference location.

In an alternative embodiment of the invention, and as schematically illustrated in FIG. 1, the virtual reality display sensor 40 could be in the form of a gyroscope 49. In this alternative form of the invention, the gyroscope 49 would be used in lieu of the sensor assembly 57 mounted on the other side 42 of the helmet 14. The gyroscope 49 would produce an output signal indicative of the orientation of the head mounted display 12 relative to a fixed location and would eliminate the need for the light projector 46.

Turning again to FIG. 3, unit 50 includes a display assembly 61 that is operably connected to the head mounted display unit 12. In one form, the display unit 61 includes a scene projector 62 for providing a visual display of an environmental image to the screen 26 of the head mounted display 12 such that the shooters wearing the helmet 14 appears emersed in the environmental scene or image on the screen 26. The scene projector 62 comprises an apparatus from the class comprised of: a video cassette recorder, a television, a film projector, a motion picture projector, a laser projector, an infrared light emitter, a visible fight emitter, a camera, or other suitable device capable of projecting images generated by video cassettes, compact discs, or other image storing methods. As such, the shooter S is permitted to choose the particular environmental image to be displayed on the screen 26 of the head mounted display 12.

To allow various targets 28 to likewise be displayed on the screen 26 of the head mounted display 12, one form of the display apparatus 61 of unit 50 further includes a target projector 64 that is operably coupled to the head mounted display 12. The target projector 64 provides a visual image of a path of travel of a moving target 28 on the environmental image for the screen 26 of the head mounted display 12. The target projector 64 comprises an apparatus from the class comprised of: a CDI system, a video cassette recorder, a video disc projector, a television, a film projector, a motion picture projector, a laser projector, an infrared light emitter, a visible fight emitter, a camera, or other suitable device capable of projecting images generated by video cassettes, compact discs, or other image storing methods. As such, the shooter S is permitted to choose the particular path of travel of the target 28 to be displayed on the screen 26 of the head mounted display 12 preferably in superimposed relation relative to the environmental image displayed by the display apparatus 61.

The video cassettes, compact discs or other image storing devices utilized by the target projector 64 can display the image of the target 28 in different directions, different inclines, and at different speeds. When the shooter is practicing skeet, the target projector 64 preferably sequentially projects moving picture scenes taken from the various skeet stations showing the flight of the target 28 exactly as it occurs in real life. In any case, under all the various methods of projecting the target 28, the shooter S may remain in one position at all times while targets 28 of different directions and angles are presented to the shooter S.

In an alternative embodiment, the display unit 61 can include a single apparatus for displaying both the environmental image or scene and the target onto the screen 26 of the head mounted display system 12. Such a display unit could be loaded with various programs or the like indicative of the image and target path desired for a particular environment. This alternative form of the present invention would preferably utilize a tape, a disc, or other suitable data recording medium associated therewith for indicating the disposition of the target at all times during its path of travel. That is, the informational data on the tape or disc would include information relating to the speed(s) of the target 28 and the external delay time required for a simulated projectile to reach the plane of the target could likewise be inputted to a microprocessor or computer 66 forming part of unit 50 (as described below) as a function of the particular target selected by the shooter S. The tape or disc associated with the display unit 61 can be continuously coded with informational data relating to the target's path of travel so that such informational data is relayed to the computer or microprocessor 66 at the time the shot is taken by the shooter S.

The computer or microprocessor 66 operably associated with unit 50 defines a central processing unit for the shooting simulating process and training apparatus 10 of the present invention. As will be appreciated by those skilled in the art, the central processing unit 66 is operably coupled to the visual display apparatus 61, the barrel positioning sensor unit 34, and the virtual reality display sensor unit 40.

In that embodiment of the invention wherein the scene projector 62 and target projector 64 are individualized rather than arranged as one unit, and as schematically illustrated in FIG. 3, the central processing unit 66 includes a scene positioning unit or apparatus 70 that receives signals from the virtual reality display sensor 40 and, in turn, controls the scene projector 62 of the visual display apparatus 61 such that the environmental scene on the concave screen 26 of the head mounted display system 12 is displayed as a function of the orientation of the helmet 14 of the shooter S relative to the fixed location 44 as monitored by the sensor unit 40 in accordance with technology that is known in the art of virtual reality.

In that embodiment of the invention wherein the scene projector 62 and target projector 64 are individualized rather than arranged as one unit, the central processing unit 66 furthermore includes a target positioning apparatus 72 that controls the target projector 64 of the visual display apparatus 61 to influence the presence and path of movement or travel of the target 28 on the screen 26 of the display 12, as presented to the eyes of the shooter S, just as it would appear to the shooter S if they were moving and viewing the scene projected on a fixed external wall, or in an actual setting in accordance with technology that is well known in the art of virtual reality.

When the scene projector 62 and the target projector 64 are eliminated and only one apparatus is utilized to display both the target and the environmental image or scene on the head mounted display system 12, the apparatus for conjointly displaying both the scene and target would likewise be connected to the microprocessor 66.

In addition to the foregoing, a simulated barrel position is also displayed on the screen 26 of the head mounted display 12 preferably in relation to the environmental scene on the screen 26 of the display 12 and relative to the target 28 moving through the environmental scene. As shown in FIGS. 4 and 5, in a preferred form of the invention, the position of the barrel 22 of the weapon 16 (FIG. 1) is displayed as a small "barrel position image" 76 on the screen 26 of the head mounted display 12. The barrel position image 76 on the screen 26 of the display 12 is derived by the central processing unit 66 from a series of signals provided to the unit 50. That is, the barrel position image 76 is derived as a function of the relationship or orientation of the helmet 14 relative to the fixed location 44 as monitored by the virtual reality sensor unit 40, in conjunction with the barrel position sensor unit 34. Notably, the position of the barrel position image 76 is preferably displayed on the screen 26 of the head mounted display 12 at all times while the scene is being portrayed or projected onto the screen 26 of the head mounted display 12 until the shot has exited the muzzle of the weapon 16 and then the shot pattern or other shot indicator is "frozen" and displayed.

As will be appreciated, in normal shooting situations, there is a certain "internal delay time" (measurable in fractions of a second) between when the trigger 20 (FIG. 2) of the weapon is sufficiently manipulated to "fire" the weapon 16 and the time a projectile exits the muzzle of the weapon 16. The internal delay time corresponds to the time between which the trigger sear of a gun slips, i.e. the point at which a trigger 20 is pulled, and the time at which the shot charge or projectile leaves the muzzle of the weapon 16. The internal delay time takes into consideration the time of the hammer to fall, the primer to explode, the powder to ignite and its gases expand and force the projectile through and out of the barrel 22 of the weapon 16. A circuit 77 (FIG. 2) or other suitable apparatus is embodied into the barrel position indicator 32 to provide the internal delay time.

The position of the barrel 22 of the weapon 16 at the instant when a simulated projectile would leave the muzzle of the weapon 16, and after the expiration of the internal delay time, is simulated by causing the barrel position projector 32 to flash with a second or different level of light than was heretofore rearwardly shown by the projector 32. This flash of the barrel position projector 32 is sensed by the barrel position sensor 34 and the central processing unit 66 is signalled accordingly.

For purposes that will become apparent from the following description, and as shown in FIG. 3, the unit 50 can further include an energizer apparatus 80 coupled to the display assembly 61. The energizer apparatus 80 is operably coupled to and causes the display assembly 61 to display either: only the target 28 on the screen 26 of the head mounted display 12; or, the target 28 and environmental scene on the screen 26 of the head mounted display system 12. In a most preferred form of the invention, the energizer apparatus 80 is voice activated.

In that embodiment of the invention, wherein the scene projector 62 and target projector 64 are individualized rather than arranged as a common unit and there is no data medium associated with the display assembly 61 for specifically indicating the position of the target 28, the unit 50 may further includes a target timing apparatus 82 that is operably coupled to the target projector 64 for monitoring the extent of time the target 28 is projected onto the screen 26 of the head mounted display 12, and a target position memory 84. In that embodiment of the invention wherein the display assembly 61 includes a data recording medium such as a coded tape or disc containing informational data regarding the target, the target timing apparatus 82 can be eliminated.

In the illustrated form of the invention, the target timing apparatus 82 is responsive to the energizer apparatus 80. In this manner, the central processing unit 66, which has been programmed with and thus "knows" the trajectory path of the target 28, and can calculate where the target 28 is along its predetermined path of travel as a function of the amount of time which passes since the target 28 initially appeared on the screen 26 in response to activation of the target projector 64 by the target energizer apparatus 80.

During ting or practice, e.g. in the clay target game of skeet, the target 28 appears on the screen 26 of the display 12 when the shooter S or other suitable person activates or energizes the energizer apparatus 80 thereby allowing the display assembly 61 to initially display or project either only the target 28 or the target and scene on the screen 26 of the display 12. In a most preferred form of the invention, the shooter S calls "pull" and the voice activated energizer apparatus 80 thereby enables the display assembly 61 to project or otherwise display the target 28 or the target and the scene on the screen 26 of the head mounted display system 12.

Suffice it to say, the target 28 appears to move through or along its predetermined path of travel on the screen 26 of the display 12 and preferably through the environmental image projected or otherwise displayed on the screen 26 by the display assembly 61. As mentioned above, the target 28 moves on the screen 26 of the head mounted display 12 at predetermined speeds and at selected angles to simulate various speeds, angles and distances representing those normally presented to a shooter at various skeet stations. In this regard, the microprocessor 66 includes a target position memory portion 84 that can be programmed with information concerning the exact location of the target 28 as it passes along different paths of travel or trajectories and at different speeds depending upon the particular target chosen by the shooter S at the onset of the training exercise.

During use of the shooting simulator and training apparatus 10 of the present invention, the shooter S moves the weapon 16 to catch up to, pass and stay ahead of the simulated target 28 in order to "hit" it as the target moves along its predetermined path of travel. As the shooter S moves the weapon 16, the position of the barrel 22 of the weapon 16 in relation to the target 28 and preferably in relation to the environmental scene, is displayed or otherwise projected on the screen 26 of the display 12 as the barrel position image 76 as a result of simultaneous signals from the barrel position sensor unit 34 and the virtual reality sensor unit 40, being inputted to the unit 50 that in turn causes the display assembly 61 to display the barrel position in a conventional well known manner.

With respect to the particular embodiment of the invention schematically illustrated in FIGS. 1 and 3, as the shooter S moves in order to track the target 28 moving on the screen 26 of the head mounted display 12, the fixed light cross-hair pattern 48 coacts with the sensor unit 40 to monitor the orientation of the head mounted display 12 relative to the fixed location 44. As will be appreciated from an understanding of this embodiment of the invention, the cross-hair pattern 48 sequentially activates two individual sensors in the horizontal rows 58 and 59 of light detecting sensors of the sensor assembly 57 as well as and two individual sensors in the vertical rows 60 of light detecting sensors on the rear side or surface 42 of the head mounted display 12 thus determining the position of the environmental scene on the screen 26 of the display 12 including the target 28 moving on the scene depicted on the screen 26.

Contemporaneously, the light projected rearwardly from the projector 32 sequentially activates the two individual sensors 54 and 56 on the front side or surface 36 of the head mounted display system 12. As mentioned above, if the weapon 16 is not correctly positioned by the shooter S, the sensors 54 and 56 will not detect the light emitted rearwardly from the barrel position indicator 32 and, thus, the unit 50 will inhibit the display assembly 61 from illustrating a display on the head mounted display system 12. When the weapon 16 is properly positioned, however, the sensors 54 and 56 detect such proper positioning and, thus, determine the position of the barrel position image 76 within the scene shown on the head mounted display 12.

When the shooter S judges that a correct amount of forward allowance i.e. "lead" in front of the target 28, the shooter S pulls the trigger 20 of the weapon 16. When the shooter S pulls the trigger 20, and after expiration of the internal delay time, the barrel position projector 32 causes the projector 32 on the barrel 22 of the weapon to direct a flash of different intensity light rearwardly toward the front side 36 of the head mounted display 12 which is detected by the barrel position sensor unit 34. When the barrel position sensor unit 34 detects the flash of light from the projector 32 indicative of the simulated shot or projectile leaving the muzzle of the weapon 16, the sensor unit 34 signals the target positioning memory portion 84 of the microprocessor 66 so that it can determine the position of the target 28 at such time.

Simultaneously, the virtual reality display sensor unit 40 monitors the orientation of the helmet mounted display 12 relative to the fixed location 44. The two simultaneous outputs or readings from the barrel positioning sensor unit 34 and the display sensor unit 40 are applied to the microprocessor 66 which then determines the correct "external delay" time i.e. the time which is normally required for a shot charge, bullet or projectile to normally travel from the muzzle of the barrel of a weapon under actual conditions to the point where it intersects the vertical plane of any particular target 28.

The external delay time or flight time of the simulated projectile can be determined by entering an input programmed lookup table into an external delay memory portion 88 of the computer or microprocessor 66 to generate the appropriate elapsed time for a simulated projectile to travel the distance to that point on the vertical plane of the target 28 simulated by the direction of the barrel 22 as monitored by the projection of the flash of light from the projector 32 toward the barrel position sensor unit 34, along with the simultaneous signals from the virtual reality display sensor unit 40 at the completion of the internal delay time. Preferably, the lookup table of the external delay memory portion 88 is preprogrammed or inputted, such as by a keyboard, into the microprocessor 66 based on the particular skeet station and shot, and projectile being simulated. Where a video cassette or disc is utilized to display the target 28, the external delay times may be inputted for any particular simulated shot by a signal from the video cassette or disk at the commencement of the display of the particular shot being taken.

In that embodiment of the invention utilizing a separate target projector to display the target 28 on the scene of the head mounted display system 12, at the time the target projector 64 commences to project the target image 28 onto the screen 26 of the head mounted display 12, the timer apparatus 82 is simultaneously activated and provides a signal to the microprocessor 66 indicative of the length of time the target 28 is moving until the light-emitting barrel position indicator or projector 32 flashes indicating the point at which the projectile exited the barrel 22 of the weapon 16 (i.e. after expiration of the internal delay)o Based on the particular target 28 chosen by the shooter S to be simulated on the screen 26 of the head mounted display 12, the target position memory portion 84 of the microprocessor 66 determines the position of the target 28 along its path of travel when the barrel position projector 32 flashes a light rearwardly toward the barrel position sensor 34 on the head mounted display indicative of the time the simulated projectile exits the muzzle of the weapon 16.

The additional elapsed time attributable to the external delay or expectant flight time of the simulated projectile to reach the point on the path of the target at which it was directed when it exited the muzzle of the weapon 16 is computed by the external delay memory portion 88 of the microprocessor 66. The microprocessor 66 then calculates or otherwise ascertains the additional distance traveled by the target 28 during this external delay time and then the target-positioning apparatus 72 of the microprocessor 66 causes the target projector 64 to display the target 28 at such position.

As will be appreciated by those skilled in the art of weaponry, different weapons have different projectiles. That is, a rifle which fires a single bullet has a relatively small diameter bullet projected from the end of the muzzle of the weapon. On the other hand, other weapons, such as shotguns, offer a wider shot pattern. As will be appreciated, the further the distance from the muzzle of the weapon, the larger is the shot pattern associated with a shotgun.

In a most preferred form of the invention, the computer 66 is programmed such that the shooter can furthermore modify the training process by indicating which weapon is being used and thereby choosing which shot pattern or army is going to be associated with the training process. In this regard, and as represented in FIG. 3, a shot display unit or apparatus 86 is operably associated with the computer 66. The shot display unit 86 has the ability to display a shot pattern 88 (FIG. 5) normally associated with a particular weapon (as chosen by the shooter S) on the screen 26 of the head mounted display 12. Of course, the pattern 88 displayed in the screen 26 will be representative of the pattern that such shot would be expected to assume under actual conditions and given the distance traversed by the shot relative to the shooter S.

Preferably, the pattern 88 representing the pellets of shot discharged from the muzzle of the weapon 16 is displayed on the screen 26 of the head mounted display 12 at the same relative position of the barrel position image 76 representing the point at which the shooter S was aiming when the simulated projectile would have exited the muzzle of the weapon 16. The function of the shot display unit 86 is to allow the relative positions of the both the target 28 and the shot pattern 88, at the point in time that the simulated projectile would have crossed the vertical plane of the target 28, to be displayed on the screen 26 of the head mounted display to show both whether a "hit" or a "miss" resulted and, if a "miss" resulted, where and by what relative distance the miss would have occurred, to enable the shooter S to correct their aim on the next shot. The shot pattern 88 could be of less intensity than the image of the target 28 or can merely be a circle.

Returning to FIG. 3, unit 50 can further include a stop action apparatus 90 to hold the superimposed images of the target 28 and the shot pattern 88 (FIG. 5) generated by the shot display unit 86 on the screen 26 of the head mounted display 12 in stop motion until released by the shooter S. The stop action apparatus 90 is responsive to the flash of the second or different intensity of light from the projector 32 indicative of the simulated projectile exiting from the muzzle of the weapon 16. When the shooter S resets the shooting simulator and trainer apparatus 10 for the next shot, the target positioning memory portion 84 is likewise reset and the shot pattern display 88 is cancelled from the screen 26 of the head mounted 12.

The internal delay time, i.e. the time between the trigger sear slipping and the exit of the shot from the muzzle of the barrel 22 (FIG. 1) of the weapon 16 is preferably inherent with the barrel position projector 32 so that a fixed delay elapses between the time the shooter pulls the trigger 20 and the time the barrel position indicator projector 32 flashes. This exactly simulates the events which occur when actually shooting, since between the time the trigger sear slips and the time the shot exits the muzzle (i.e. the internal delay time) the shooter S may be increasing or decreasing the actual lead on the target 28 from that which the shooter S saw when the shooter S pulled the trigger 20, depending on whether the shooter S was swinging the barrel 22 of the weapon 16 so that the muzzle's point of aim on the vertical plane of the target 28 was moving more or less rapidly than the target 28 itself during this interval.

Furthermore, in some situations, e.g. military or police targets, where longer ranges are simulated, the lookup table which can be inputted and interrogated by the microprocessor 66 and associated apparatuses can include information concerning the predetermined trajectory of the simulated projectile such as a bullet fired by any simulated cartridge, as well as other information. This will provide information which is relayed to the display assembly 61 to display the amount which the simulated projectile falls, and thereby, the corrective amount or degree, the muzzle of the barrel 22 of the weapon 16 should be held above the target 28 at any given simulated distance from the target 28, as well as the amount of lead required at such a distance.

When various programs for the target positioning apparatus 72 of the microprocessor 66 are used in conjunction with the target projector 64, each point on the screen 26 of the target's path can be designated to represent a specific distance from the muzzle of the weapon 16 to simulate the path of any target 28 at any angles, distances and speeds. Furthermore, the target 28 can be made to slow down, as would a clay pigeon after leaving a trap, or speed up, as would a bird after being flushed. Moreover, the flight of the target 28 can be simulated to fall or rise along a desired path. Alternatively, tapes or discs showing actual pictures of various targets 28 in any type of shooting game (e.g. skeet, trap, duck tower, running boar, etc.) or moving military or police targets may be shown by the display assembly 61 and displayed on the screen 26 of the head mounted display 12. As mentioned above, such tapes or discs preferably include a recording medium that provides to the processor 66 the exact location of the target 28 as it moves across the screen 26 of the display assembly 12.

Various programs for the external delay memory portion 86 of the microprocessor 66 can be used to indicate the time of travel ("external delay") of a projectile having any given initial and interim velocities from the muzzle of the weapon to any point on the vertical plane of the target 28 as the distance to the target's vertical plane increases or decreases. Desirably, this simulation can be accomplished for any path, angle and distance of any target 28. In the event tapes or discs are utilized to display various targets, information concerning the external delays associated with the path of a particular target 28 can be inputted into the external delay memory 86 from the coded informational data on the tape or disc at the commencement of the target display.

In those embodiments of the invention that do not utilize a tape or disc having the position of the target thereon, the timer apparatus 82 of unit 50 can be used in conjunction with the target positioning memory portion 84 of the microprocessor 66 to signal and indicate the time of travel and therefore the simulated position of the target 28.

Based upon the simulated distances from the muzzle of the barrel 22 of the weapon 16, the microprocessor 66 calculates and determines the time of travel of the projectile to strike the plane of the target 28 having any direction, angle, and speed, along a desired straight or curved rising or falling path. The target position memory portion 84 of the microprocessor 66 receives impulse signals from the target projector 64 at the inception of travel of the target 28 as well as from the barrel position sensor 34 when it receives a flash of light directed rearwardly from the projector 32 representing the simulated projectile at the time it is leaving the muzzle after expiration of the internal delay time. The microprocessor 66 concurrently calculates or determines the position of the particularly chosen target 28 during its flight along a predetermined trajectory.

The variable external delay portion 86 of the microprocessor 66 likewise receives signals from the barrel position sensor unit 34 and the virtual reality display sensor unit 40 simultaneously in order to determine and indicate the position of the barrel position image 76 (FIG. 2), i.e., the line of sight the shooter S had at the time the weapon was "fired" and after the expiration of the internal delay. The microprocessor 66 can be preprogrammed to indicate the time required for a shot charge or projectile of any given initial and interim velocities to reach all possible aiming points along the target's vertical plane (i.e. the external delay time). The microprocessor 66 automatically calculates and determines the distance the target 28 will travel during this external delay time until the projectile would reach that point on the vertical plane of the target 28 at which it was directed, and therefore the position of the target 28 at such time, for any angles, paths and speeds of the target and projectile, based upon signals and information relayed from the target positioning apparatus 72.

In one form of the invention, and to enhance the training capacity of the present invention, the stop action apparatus 90 of the microprocessor 66 cooperates with the target projector 64 to display and project the exact relative positions of any moving target 28 and the shot pattern or projectile 88 directed at such target 28 at the time such shot charge or projectile reaches the vertical plane of the target 28.

Figure 6:
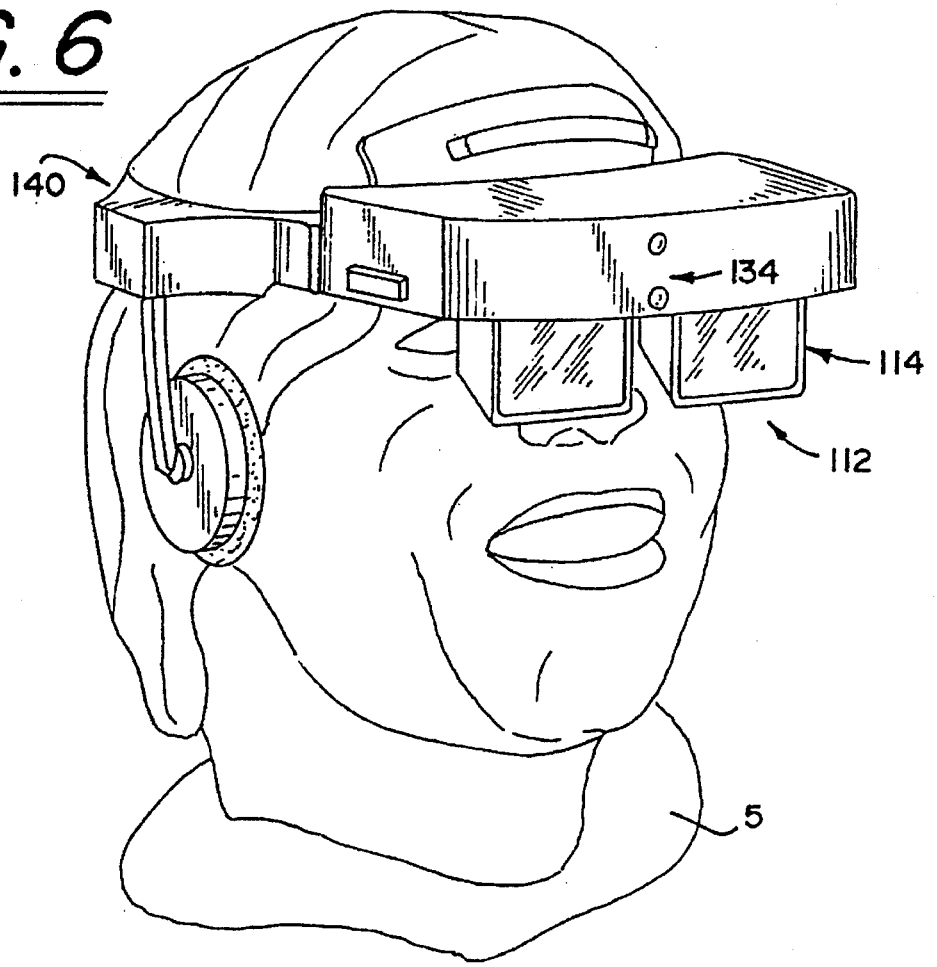
FIG. 6 is a schematic representation of another form of head mounted display that can be used in combination with the present invention.
Figure 7:
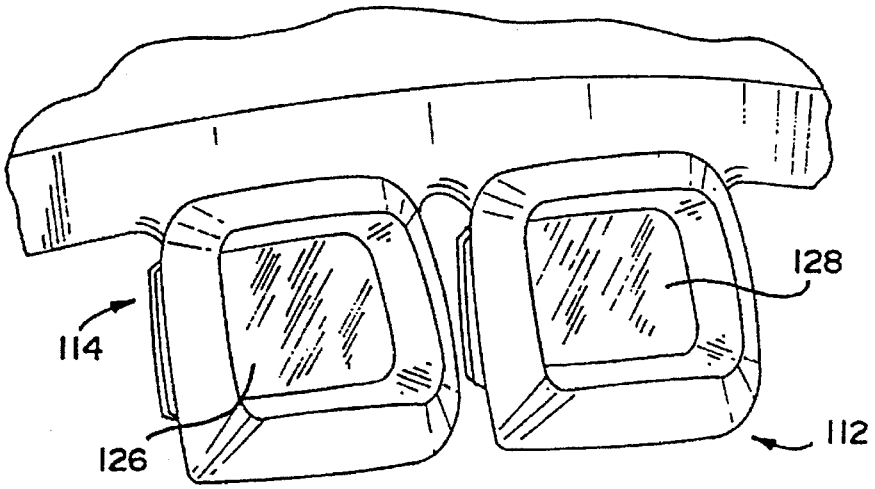
FIG. 7 is a schematic representation of a screen provided by the head mounted virtual reality display illustrated in FIG. 6.

Another embodiment of a virtual reality head mounted display is schematically illustrated in FIGS. 6 and 7 and is generally designated therein by reference numeral 112. The virtual reality head mounted display 112 is similar, and functions in a similar manner to the helmet-like embodiment of the display described above. That is, the head mounted display 112 is coupled to the microprocessor and includes sensor units 134 and 140. Suffice it to say, the sensor units 134 and 140 are essentially the same as sensor units 34 and 40 discussed above. The elements of the alternative embodiment of the head mounted display 112 indicated in FIGS. 6 and 7 that are identical or functionally analogous to those of the helmet-like display 12 discussed above are designated by reference numeral in the 100 series.

Suffice it to say, the head mounted display 112 comprises glasses 114 that fit about the head of the shooter S and are read fly removable when desired by the shooter S. The head mounted glasses 114 have two, relatively small screens 126 and 128 that fit over the eyes of the shooter S such that the shooter is immersed in the scene depicted or projected to the screens 126 and 128 by the display apparatus 61 (FIG. 3). Preferably, the two screens 126 and 128 are comprised of two liquid crystal monitors that display slightly different images which the shooter S who is wearing the display 112 perceives into one three dimensional view or image.

With either embodiment of the head mounted display of the present invention, the training apparatus 10 of the present invention takes into account the distance and in what direction the muzzle of the weapon 16 moves during the internal delay time in order to show the position of the shot charge or projectile when it reaches the vertical plane of the target 28, thereby replicating the sequence of events which occurs under the actual shooting conditions. The training apparatus 10 of the present invention also simulates how the moving target 28 traveling at any speed, direction and distance may be hit with any type of charge or projectile possessing any initial and interim velocities and any trajectory. Furthermore, the shooting simulating processes and training apparatus 10 of the present invention senses, detects, determines and displays the relative positions of the target and projectile after the projectile has reached the vertical plane of the target.

If desired, different software programs can be inputted in the microprocessor 66 to simulate an infinite number of target speeds, directions, and angles in which the target 28 can be speeding up or slowing down, in combination with any number of different projectiles which can commence at any number of velocities and slow and drop at any number of rates. Moreover, and if so desired, information can be inputted to the microprocessor from a tape or disk for each shot type at the time the shot is called for by a signal from the video display unit 61. Such information can be provided through the energizer apparatus 82. Desirably, the shooting simulating processes and training apparatus 10 of the present invention is capable of visually showing results of shooting at a rapidly moving target where the distances from the muzzle of the gun to the target are changing rapidly during the time the shot is being taken. In particular, the shooting simulating processes and training apparatus 10 of the present invention accurately demonstrates the results of a shot taken at a rapidly moving target which is quartering away or towards the shooter, or even one which is quickly crossing the shooter's path at a right angle. In the case of a target which is rising or falling directly away from the shooter, the target's plane can be represented by various horizontal planes rather than a vertical plane, if desired.

Whether the target timer apparatus 82 is used in conjunction with the target position memory apparatus 84 or whether a tape or disk having continuous information concerning the position of the target is used in conjunction with such target position memory apparatus 84, the central processing unit 66 always "knows" where the target 28 is as it moves on the screen 26 of the head mounted display 12. Unit 50 is programmable for each target 28 which the shooter S wishes to practice. That is, each such target's direction, inclination and speed are programmed into the unit 50 so that for that target each point the screen represents a specific simulated distance to the target's plane and therefore a specific "external delay." Accordingly, the unit 50 "knows" where the target 28 is when the projector 32 flashes (after an internal delay) to indicate exit of the simulated projectile from the muzzle of the weapon 16, senses where the shot went, applies the appropriate external delay for that simulated distance and therefore knows where the target 28 is at the end of this delay which is the time the shot intersects the target's plane, and so can display the relative position of both at such time.

Among the many advantages of the novel shooting simulating processes and training devices are:

1. Outstanding performance and accuracy.
2. Superior training.
3. Excellent improvement of shooting skills.
4. Better detection of target impact time and location.
5. Enhanced tracking of moving targets and projectiles.
6. User friendly.
7. Simple to operate.
8. Economical.
9. Reliable.
10. Convenient.
11. Efficient.
12. Effective.
13. Realistic.

Although embodiments of the invention have been shown and described, it is to be understood that various modifications and substitutions, as well as rearrangements of parts, components, equipment and process steps, can be made by those skilled in the art without departing from the novel spirit and scope of this invention.

What is claimed is:

1. A ballistic simulating and training system, comprising:

a virtual reality head mounted display equipped with a screen that fits over and in front of a person's eyes;

a weapon selected from the group consisting of a shotgun and a rifle, wherein said weapon includes a trigger with a sear and a barrel providing a muzzle;

a light projector mounted on the barrel of the weapon for optically projecting light rearwardly toward said head mounted display for simulating the aiming point of the weapon's barrel while the weapon is being aimed including at the time a projectile would exit the muzzle of said weapon;

a first sensor operably connected to the head mounted display for producing an output signal representing the orientation of the head mounted display relative to a fixed location;

a second sensor mounted on the head mounted display and responsive to the optical light projected from said light projector for producing an output signal representing orientation of the barrel of the weapon relative to said fixed location and the trajectory of the projectile from said weapon;

a screen projector for providing a visual display of an environmental image for the screen of the head mounted display;

a target projector for providing a visual display of a path of travel of a moving target on the environmental image for the screen of the head mounted display; and a unit including a central processing unit operably coupled to said screen projector, said target projector, and said first and second sensors, said central processing unit controlling the environmental image displayed on the screen of the head mounted display such that the person wearing said head mounted display is immersed in and relative to the environmental image displayed on said screen as a function of the orientation of said head mounted display relative to said fixed location as monitored by said first sensor, and wherein said central processing unit automatically calculates the positions of the projectile and said moving target when the trajectory of said projectile intersects the path of travel of the moving target and to calculate whether said target has been hit or missed by said projectile, wherein said central processing unit automatically determines the position of the target at the time the projectile leaves the muzzle of the weapon, said central processing unit furthermore calculates the external delay time required for the projectile after leaving the muzzle to intersect a simulated plane of the target based on output signals from said first and second sensors, said calculations being based upon the velocity and time of travel of the said projectile to the point of intersection, and wherein said central processing unit further calculates the distance said target will travel on said path of travel during said external delay time to determine the position of the target at the conclusion of said external delay time and to automatically determine the relative positions of the said target and projectile at the expiration of said external delay time, and wherein said central processing unit includes an apparatus for causing the positions of said target and said projectile calculated by said central processing unit at the time the trajectory of the projectile intersects with the path of travel of the target to be displayed on the screen thereby providing a visual indication of a hit or miss of the projectile relative to said target.

2. The ballistic simulating and training system according to claim 1 wherein the position of said target is calculated commencing upon activation of said target.

3. The ballistic simulator and training system according to claim 1 wherein said second sensor includes a light sensing apparatus selected from the group consisting of: infrared sensing monitors, normal light sensing monitors, optical fibers, and liquid crystals.

4. The ballistic simulator and training system according to claim 1 wherein said target projector is an apparatus selected from the group consisting of: a television projector, a movie projector, a camera, a computer, a video disc player, and a video recorder.

5. The ballistic simulator and training system according to claim 1 further including a voice activator coupled to said target projector.

6. The ballistic simulator and training system according to claim 1 wherein said first sensor includes an apparatus selected from the group consisting of: a light sensing apparatus, a radio signal sensing apparatus, a magnetic field sensing apparatus, and a gyroscope.

7. The ballistic simulator and training system according to claim 1 wherein said head mounted display includes a helmet having a concave screen on an interior thereof.

8. The ballistic simulator and training system according to claim 7 wherein said first sensor comprises an army of light sensors mounted about a rear side of said helmet.

9. The ballistic simulator and training system according to claim 1 wherein said virtual reality head mounted display comprises glasses with two relatively small screens that fit over the eyes of the person wearing the head mounted display to immerse the wearer in the images they see.

10. The ballistic simulator and training system according to claim 9 wherein said two screens are comprised of two liquid crystal monitors that display slightly different images which the person wearing the head mounted display perceives into one three-dimensional view.

11. The ballistic simulator and training system according to claim 1 wherein said light projector includes an internal delay timer that is connected and responsive to manipulation of the trigger on the weapon for delaying the indication of when the projectile exits the muzzle of the weapon.

12. A ballistic simulating and training system, comprising:

a virtual reality head mounted display equipped with a screen that fits over and in front of a person's eyes;

a weapon selected from the group comprising a shotgun and a rifle, wherein said weapon includes a trigger with a sear and a barrel providing a muzzle;

a light projector mounted on the barrel of the weapon for optically projecting tight rearwardly toward said head mounted display for simulating the aiming point of the weapon's barrel while the weapon is being aimed including at the time a projectile would exit the muzzle of said weapon;

a first sensing apparatus operably associated with the head mounted display for producing an output signal representing the orientation of the head mounted display relative to a fixed location;

a second sensing apparatus operably associated with the head mounted display and responsive to the optical light projected from said tight projector for producing an output signal representing orientation of the barrel of the weapon relative to said fixed location and the trajectory of the projectile from said weapon;

a display apparatus for providing a visual image of an environment and a target movable along a predetermined path of travel on the screen of the head mounted display, said display apparatus further including a medium having machine readable data thereon indicative of various target positions as said target moves along said predetermined path of travel; and a unit including a central processing unit operably coupled to said display apparatus, to said first sensing apparatus, and to said second sensing apparatus, said central processing unit controlling the environmental image and target displayed on the screen of the head mounted display such that the person wearing said head mounted display is immersed in and is presented with views of the environmental image and target displayed on said screen as a function of the orientation of said head mounted display relative to said fixed location as monitored by said first sensing apparatus, wherein said central processing unit automatically determines the position of the target at the time the projectile leaves the muzzle of the weapon based on what is read from the readable data on the medium of said display apparatus, said central processing unit furthermore calculates the external delay time required for the projectile, after leaving the muzzle, to intersect a simulated plane of the target based on output signals from said first sensing apparatus and said second sensing apparatus, said calculations being based upon the velocity and time of travel of the said projectile to the point of intersection, and wherein said central processing unit further calculates the distance said target will travel on said path of travel during said external delay time based on what is read from the readable data on the medium of said display apparatus to determine the position of the target at the conclusion of said external delay time and thereby automatically determine the relative positions of the said target and projectile at the expiration of said external delay time, and wherein said central processing unit further includes an apparatus for causing the positions of said target and said projectile calculated by said central processing unit at the time the trajectory of the projectile intersects with the path of travel of the target to be displayed on the screen thereby providing a visual indication of a hit or miss of the projectile relative to said target.

13. The ballistic simulating and training system according to claim 12 wherein the position of said target is determined commencing upon activation of said target.

14. The ballistic simulator and training system according to claim 12 wherein said second sensing apparatus includes a light sensing apparatus, said light sensing apparatus is: infrared sensing monitors, normal light sensing monitors, optical fibers, or liquid crystals.

15. The ballistic simulator and training system according to claim 12 wherein said display apparatus is: a television projector, a movie projector, a camera, a computer, a video disc player, or a video recorder.

16. The ballistic simulator and training system according to claim 12 further including a voice activator coupled to said display apparatus.

17. The ballistic simulator and training system according to claim 12 wherein said first sensing apparatus is: a light sensing apparatus, a radio signal sensing apparatus, a magnetic field sensing apparatus, or a gyroscope.

18. The ballistic simulator and training system according to claim 12 wherein said virtual reality head mounted display includes a helmet having a concave screen on an interior thereof.

19. The ballistic simulator and training system according to claim 18 wherein said first sensing apparatus comprises an array of light sensors mounted about a rear side of said helmet.

20. The ballistic simulator and training system according to claim 12 wherein said virtual reality head mounted display comprises glasses with two relatively small screens that fit over the eyes of the person wearing the head mounted display to immerse the wearer in the images they see.

21. The ballistic simulator and training system according to claim 20 wherein said two screens are comprised of two liquid crystal monitors that display slightly different images which the person wearing the head mounted display perceives into one three-dimensional view.

22. The ballistic simulator and training system according to claim 12 wherein said light projector includes an internal delay timer that is connected and responsive to manipulation of the trigger on the weapon for delaying the indication of when the projectile exits the muzzle of the weapon.

23. A ballistic simulating and training system, comprising:

a virtual reality head mounted display equipped with a screen that fits over and in front of a person's eyes;

a weapon selected from the group consisting of a shotgun and a rifle, wherein said weapon includes a trigger with a sear and a barrel providing a muzzle;

a light projector mounted on the barrel of the weapon for optically projecting light rearwardly toward said head mounted display for simulating the aiming point of the weapon's barrel while the weapon is being aimed including at the time a projectile would exit the muzzle of said weapon;

a first sensor operably connected to the head mounted display for producing an output signal representing the orientation of the head mounted display relative to a fixed location;

a second sensor mounted on the head mounted display and responsive to the optical light projected from said light projector for producing an output signal representing orientation of the barrel of the weapon relative to said fixed location and the trajectory of the projectile from said weapon;

a target projector for providing a visual display of a path of travel of a moving target on the screen of the head mounted display; and a unit including a central processing unit operably coupled to said target projector and said first and second sensors, said central processing unit controlling the target displayed on the screen of the head mounted display such that the person wearing said head mounted display visualizes the movable target displayed on said screen as a function of the orientation of said head mounted display relative to said fixed location as monitored by said first sensor, and wherein said central processing unit automatically calculates the positions of the projectile and said moving target when the trajectory of said projectile intersects the path of travel of the moving target to calculate whether said target and has been hit or missed by said projectile, wherein said central processing unit automatically determines the position of the target at the time the projectile leaves the muzzle of the weapon, said central processing unit furthermore calculates the external delay time required for the projectile after leaving the muzzle to intersect a simulated plane of the target based on output signals from said first and second sensors, said calculations being based upon the velocity and time of travel of the said projectile to the point of intersection, and wherein said central processing unit further calculates the distance said target will travel on said path of travel during said external delay time to determine the position of the target at the conclusion of said external delay time and to automatically determine the relative positions of the said target and projectile at the expiration of said external delay time, and wherein said central processing unit includes an apparatus for causing the positions of said target and said projectile calculated by said central processing unit at the time the trajectory of the projectile intersects with the path of travel of the target to be displayed on the screen thereby providing a visual indication of a hit or miss of the projectile relative to said target.

24. The ballistic simulating and training system according to claim 23 wherein the position of said target is calculated commencing upon activation of said target.

25. The ballistic simulator and training system according to claim 23 wherein said second sensor includes a light sensing apparatus selected from the group consisting of: infrared sensing monitors, normal light sensing monitors, optical fibers, and liquid crystals.

26. The ballistic simulator and training system according to claim 23 wherein said target projector is an apparatus selected from the group consisting of: a television projector, a movie projector, a camera, a computer, a video disc player, and a video recorder.

27. The ballistic simulator and training system according to claim 23 further including a voice activator coupled to said target projector.

28. The ballistic simulator and training system according to claim 23 wherein said first sensor includes an apparatus selected from the group consisting of: a light sensing apparatus, a radio signal sensing apparatus, a magnetic field sensing apparatus, and a gyroscope.

29. The ballistic simulator and training system according to claim 23 wherein said head mounted display includes a helmet having a concave screen on an interior thereof.

30. The ballistic simulator and training system according to claim 29 wherein said first sensor comprises an array of light sensors mounted about a rear side of said helmet.

31. The ballistic simulator and training system according to claim 23 wherein said virtual reality head mounted display comprises glasses with two relatively small screens that fit over the eyes of the person wearing the head mounted display to immerse the wearer in the images they see.

32. The ballistic simulator and training system according to claim 31 wherein said two screens are comprised of two liquid crystal monitors that display slightly different images which the person wearing the head mounted display perceives into one three-dimensional view.

33. The ballistic simulator and training system according to claim 23 wherein said light projector includes an internal delay timer that is connected and responsive to manipulation of the trigger on the weapon for delaying the indication of when the projectile exits the muzzle of the weapon.

34. The ballistic simulator and training system according to claim 23 wherein said target projector includes an apparatus for displaying said target on the screen of the virtual reality head mounted display, said apparatus including an electronically recorded medium having machine readable data thereon for inputting to said central processing unit informational data indicative of the position of said target.

35. The ballistic simulator and training system according to claim 34 wherein said unit further includes a target position memory apparatus that is operably coupled to and works in operable combination with the apparatus including electronically recorded medium for locating indicating whether a hit or miss has been achieved by the person relative to the target.

36. A ballistic simulator and training process, comprising the steps of:

selecting a simulated target movable along a predetermined path of travel at predetermined speeds by programming the predetermined path of travel and predetermined speeds of said simulated target into a central processing unit;

displaying the movement of said target upon a screen of a virtual reality head mounted display as a function of the orientation of said head mounted display relative a fixed location such that different locations on said screen schematically represent different distances said target moves relative to a predetermined station;

automatically determining the location of said target at selected times as said target moves along its predetermined path of travel;

simulating aiming a freely movable weapon at said target, said weapon including a trigger with a sear and a barrel providing a muzzle, said weapon defining said predetermined station and wherein said aiming simulation step includes displaying the position of the barrel of said weapon on said screen;

simulating firing a projectile at said target from said weapon defining said station, said firing simulation step includes projecting a beam of light rearwardly toward said head mounted display from a light projector mounted on the barrel of said weapon as of the time said projectile exits the muzzle of said weapon;

detecting and displaying the aim of the weapon at all times while it is being aimed, including as of the time said projectile exits said muzzle by sensing the relationship of the alignment of said weapon with said virtual reality head mounted display and the relationship of said head mounted display relative to said fixed location; thereafter automatically determining the position of said projectile when the trajectory of said projectile intersects the plane of the path of movement of said target; and displaying the relative positions of said projectile and said target when the trajectory of said projectile intersects with the plane of the path of movement of said target thereby indicating whether said target has been hit or missed by said projectile.

37. The ballistic simulating and training process in accordance with claim 36 wherein said target is electronically located by said central processing unit through use of a target timer and a target position memory apparatus.

38. The ballistic simulating and training process in accordance with claim 36 wherein said target is electronically located through a recording medium having machine readable data thereon indicative of the position of said target in conjunction with a target position memory apparatus.

39. The ballistic simulating and training process in accordance with claim 36 including the further step of: simulating the internal delay time said projectile passes through said weapon from the time the sear of the trigger of the weapon slips to the time the projectile leaves the muzzle of the weapon; and said position of said projectile is determined in part based upon said internal delay time.

40. The ballistic simulating and training process in accordance with claim 39 including the further step of: automatically calculating an external delay time required for said projectile to travel from the muzzle of said weapon to the plane of said target, and wherein said position of said projectile is determined in part based upon said external delay time.

41. The ballistic simulating and training process in accordance with claim 36 wherein the position of said target at the time said projectile intersects the plane of said target is determined in part based on said external delay time.

42. The ballistic simulating and training process in accordance with claim 36 wherein said target moves in relationship to the person firing said weapon, and wherein the path of said target movement includes: moving said target directly or at various angles towards the person firing said weapon; moving said target directly or at various angels away from the person firing said weapon; crossing said target in front of the person firing said weapon; and, moving said target at an angle or angles of inclination relative to the person firing said weapon.

43. The ballistic simulating and training process in accordance with claim 36 including the further step of: moving said weapon towards said target.

44. The ballistic simulating and training process in accordance with claim 36 including the further step of: aiming said weapon to the left or right and above or below said moving target.

45. The ballistic simulating and training process in accordance with claim 36 wherein the step of simulating firing of said weapon includes aiming said muzzle to shoot said projectile at a position ahead of said moving target.

46. The ballistic simulating and training process in accordance with claim 36 including the further step of: displaying a simulated landscape surrounding said target upon the screen of said head mounted display, and wherein, said simulated landscape is displayed upon said screen contained in said virtual reality head mounted display as a function of the orientation of said head mounted display relative to said fixed position.

47. The ballistic simulating and training process according to claim 46 wherein the display of the simulated landscape and the target moving across said simulated landscape as seen by the shooter on the screen of the virtual reality head mounted display is determined by the relationship between a sensor unit and said fixed location.

48. The ballistic simulating and training process according to claim 46 wherein the display of the simulated landscape and the target moving across said simulated landscape as seen by the shooter on the screen of the virtual reality head mounted display is determined by a gyroscope adapted to monitor the relationship between said head mounted display and said fixed location.

49. The ballistic simulating and training process in accordance with claim 36 wherein the locations of said target are automatically calculated by said central processing unit selected from the group consisting of a computer and a microprocessor.

50. The ballistic simulating and training process in accordance with claim 36 including the step of displaying a target comprises a simulation selected form the group consisting of: a clay target, a disc, a bird, an animal, a military target, a police target, an enemy, and a criminal.

51. The ballistic simulating and training process in accordance with claim 36 wherein said target is displayed by a projector coupled to said central processing unit, said projector comprising one apparatus selected from the group consisting of: a television, a film projector, a motion picture projector, a laser projector, an infrared light emitter, a visible light emitter, a camera, an electronic signal, a video disc player, and a video cassette recorder.

52. The ballistic simulating and training process in accordance with claim 36 wherein the step of detecting and displaying the aim of the weapon involves the further step of sensing by light sensing apparatuses the position of the weapon relative to said head mounted display and the position of said head mounted display relative to a fixed reference point, said light sensing apparatuses comprising at least one member selected from the group consisting of: optical fibers, liquid display crystals, infrared detector, a monitor, fight sensors, or laser sensors.

53. The ballistic simulating and training process in accordance with claim 36 wherein the step of said displaying the relative positions of the projectile and said target includes simulating the relative distance and direction said target was missed so that the aim of the weapon can be corrected.

54. The ballistic simulating and training process in accordance with claim 36 wherein the step of displaying the movement of said target is activated by voice simulation.

55. The ballistic simulating and training process in accordance with claim 36 wherein said sensing includes use of a first sensor unit to determine the direction of the weapon's barrel relative to a virtual reality helmet and use of a second sensor unit to determine the position of the step of detecting and displaying the aim of the weapon involves the further step of sensing, said helmet relative to a fixed position.

56. The ballistic simulating and training process according to claim 36 wherein the relationship of the head mounted display relative to said fixed location is sensed by a gyroscope.

* * * * *